US005367791A

United States Patent [19]

Gross et al.

[11] Patent Number: 5,367,791

[45] Date of Patent: Nov. 29, 1994

[54] SHOE SOLE

[75] Inventors: Alexander L. Gross, Aspen, Colo.; Kiyotaka L. Nakano, Lawrenceville, Ga.

[73] Assignee: Asahi, Inc., Lawrenceville, Ga.

[21] Appl. No.: 13,598

[22] Filed: Feb. 4, 1993

[51] Int. Cl.[5] ..... A43B 13/18; A43B 21/26

[52] U.S. Cl. ..... 36/31; 36/25 R; 36/28; 36/30 A

[58] Field of Search ..... 36/25 R, 31, 28, 29, 36/30 A, 35 R, 37, 59 R, 59 B, 59 C, 114, 32 R, 59 A

[56] References Cited

U.S. PATENT DOCUMENTS

| | | | |
|---|---|---|---|
| 429,429 | 6/1890 | Eckhardt | 36/3 B |
| 997,657 | 7/1911 | Drake | 36/59 A |
| 1,297,062 | 3/1919 | Bellville | 36/59 R |
| 2,090,881 | 8/1937 | Wilson | 36/29 |
| 2,327,360 | 8/1943 | Margolin | 36/30 A |
| 2,353,829 | 7/1944 | Jakowski | 36/174 |
| 2,457,015 | 12/1948 | Van der veen | 36/35 R |
| 2,844,833 | 7/1958 | Odermatt | 36/59 A |
| 2,885,797 | 5/1959 | Chrencik | 36/32 R |
| 2,930,149 | 3/1960 | Hack et al. | 36/28 |
| 3,087,262 | 4/1963 | Russell | 36/28 |
| 4,223,456 | 9/1980 | Cohen | 36/59 R |
| 4,271,606 | 6/1981 | Rudy | 36/29 |
| 4,319,412 | 3/1982 | Muller et al. | 36/29 |
| 4,364,188 | 12/1982 | Turner et al. | 36/31 |
| 4,550,510 | 11/1985 | Stubblefield | 36/59 C |
| 4,614,046 | 9/1986 | Dassler | 36/37 |
| 4,733,483 | 3/1988 | Lin | 36/28 |
| 4,747,220 | 5/1988 | Autry et al. | 36/59 R |
| 4,798,010 | 1/1989 | Sugiyama | 36/31 |
| 4,897,936 | 2/1990 | Fuerst | 36/31 |
| 5,014,449 | 5/1991 | Richard et al. | 36/29 |
| 5,077,916 | 1/1992 | Beneteau | 36/31 |

FOREIGN PATENT DOCUMENTS

| | | | |
|---|---|---|---|
| 880711 | 4/1943 | France | 36/59 A |

*Primary Examiner*—Paul T. Sewell
*Assistant Examiner*—Marie Denise Patterson
*Attorney, Agent, or Firm*—Lowe, Price, LeBlanc & Becker

[57] ABSTRACT

A shoe sole insert has foam-filled independently compressible regions that extend through a midsole and beyond an outsole bottom surface so a particular region, when it strikes a traversed surface, is compressed vertically and expands horizontally against the midsole. In one embodiment, five groups of such regions are beneath the metatarsal bones and proximal phalanges. In a second embodiment, two transversely extending regions are beneath forward and rearward portions of the metatarsals. The rearward transverse region has a ridge that is farther from the outsole bottom face than a ridge of the forward transverse region. In another aspect, an array of regions below the tarsal and calcaneus bones is arranged so a region at the very rear of the heel compresses vertically to a greater extent than a lateral side region in response to the same striking force, so pronation tends to be corrected.

26 Claims, 8 Drawing Sheets

20
52
18
50
30
40
16
41
46
48
49
26
24
32
34
30
14
36
28

224
215
212
88
222
214
208
200
189
83
184
186
86
84
162
160
158
156
168
164
154
180
166
152
82
126
124
122
120
150
94
128
132
102
100
130
104
148
106
80
108
110
96

SHOE SOLE

TECHNICAL FIELD

The present invention relates generally to shoes and more particularly to a shoe having a sole with at least one region having a resilient tip extending beyond an outsole bottom, wherein the region includes at least one of the following features: (a) a chamber filled with foam, (b) freedom of tip movement relative to the remainder of the sole, and (c) vertical compression resulting in horizontal expansion against a shock distributing structure.

Background Art

Significant strides have been made in performance characteristics of shoes, particularly athletic shoes, for example, of the type used for walking and playing tennis. Through the use of sophisticated mechanical design techniques and cushioning materials, shoes of this type now include significant features relating to stability, traction, comfort and overcoming the effects of pronation. Despite these strides, further improvements can be made in these performance characteristics for the comfort, health and performance of a wearer of the shoes.

It is, accordingly, an object of the present invention to provide a shoe having a sole which provides greater comfort, performance and health to a wearer, particularly a wearer involved in athletic type activities, such as walking and playing tennis.

Another object of the invention is to provide a shoe having a sole with improved stability, traction and/or pronation characteristics.

Another object of the invention is to provide a shoe having a sole with an improved structure for protecting the metatarsal and/or tarsal and calcaneus bones of a wearer's foot from impact stresses.

Another object of the invention is to provide a shoe having an improved sole for reducing impact stresses in the heel portion of a wearer's foot.

An additional object of the invention is to provide a shoe having an improved sole for facilitating the forward motion of a walker.

An additional object of the invention is to provide a shoe having an improved sole for assisting natural heel-to-toe walking motion.

An additional object of the invention is to provide a pronation correction shoe having an improved sole with a rearward portion configured to help force the foot to flatten so the weight of a rearward portion of the foot is more slowly shifted from the lateral to the medial side of the foot as an outsole bottom initially strikes a surface being traversed.

The Invention

In accordance with one aspect of the invention, a shoe comprises an upper and an improved sole attached to the upper. The sole has a bottom face for contacting a surface to be traversed and at least one region that extends (i.e., protrudes) beyond the bottom face for contacting the surface. The region includes a bottom tip and a chamber extending between a foot bearing region of the shoe and the tip. The tip extends beyond the bottom face and the chamber is filled with a foam that is softer than the remainder of the sole. The bottom tip is sufficiently soft to compress when the bottom face and tip strike a surface to be traversed to transmit force resulting from the striking to the foam and thence to a force-distributing structure in the sole.

In accordance with another aspect of the invention, a shoe comprises an upper and an improved sole attached to the upper. The sole includes an outsole, a midsole and an insert. The midsole has (a) a bottom surface mating with and attached to an upper surface of the outsole and (b) a cavity where the insert is located. The insert includes at least one region that (a) extends through the midsole and outsole and (b) is not attached to the midsole or outsole. Each region includes a bottom tip extending beyond a bottom face of the outsole.

According to an additional aspect of the invention, a shoe comprises an upper and an improved sole attached to the upper. The sole has a bottom face for contacting a surface to be traversed and at least one region that extends beyond the bottom face for contacting the surface. The region includes a bottom tip extending beyond the bottom face; the region is mounted in the sole so the region moves relative to the remainder of the sole in response to the bottom face of the outsole and the tip striking the surface to be traversed.

A further aspect of the invention is concerned with a shoe having an improved sole including an outsole having a bottom face for contacting a surface to be traversed and an interior portion including a region with a bottom tip protruding beyond the bottom face. The protruding region compresses vertically in response to the bottom face of the outsole and the tip striking the surface to be traversed.

To help provide a shock-absorbing characteristic of the shoe, the bottom tip is sufficiently soft to compress vertically when the bottom face strikes the surface to be traversed to transmit the striking force to the foam, which in turn expands horizontally against a side wall of the region which expands horizontally against the shock-distributing midsole. Shock absorption and wear are enhanced by preferably forming tips and walls of the region with materials having a durometer of about 50 Asker C scale, while the foam is softer, being an open-cell foam having a durometer of about 60 Shore A scale.

To assist in providing the horizontal expansion, the protruding region has an exterior side wall that is tapered toward the tip thereof. The region is preferably shaped and arranged to move up and down relative to the remainder of the sole in response to the bottom surface and the tip striking the surface to be traversed.

In one embodiment, five longitudinally extending groups of the protruding regions are provided so each group is approximately aligned with one of the five metatarsal bones. This arrangement provides enhanced stability because different tips are displaced by differing amounts as the wearer is walking, running or pivoting his feet, e.g., as during a tennis match. The side wall taper of each protruding region is preferably displaced approximately 12°–15° relative to an axis of the region normal to the outsole bottom face to optimize the sole shock-absorbing properties. The tip thickness is substantially greater than the side wall thickness for wear and shock-absorbing optimization.

In another embodiment, particularly adapted for walking, a pair of longitudinally displaced protruding regions are arranged so they extend transversely of the outsole and are beneath the metatarsal bones. In this configuration, the tips of the regions are ridges extending approximately transversely to the outsole, near the rear portion of each protruding region. The rear region ridge is farther from the bottom of the outsole than the front region ridge. Because of this geometry and the ability of both regions to compress vertically, walking comfort is greatly increased because of a rocking motion imparted to the foot by the regions.

In accordance with a further aspect of the invention, a plurality of the protruding regions is provided in the rear portion of the sole and arranged so the tips of some of the regions have differing surface areas. Aprotruding region at the very end of the sole has a tip surface area substantially greater than that of a rear portion region on the sole lateral side so the very rear region compresses to a greater extent than the lateral side region in response to the same force being applied to each region. Hence, the lateral side region is harder than the very rear region to help force the foot to flatten and shift the bearing weight of the wearer to the medial side of the foot, and correct pronation.

The above and still further objects, features and advantages of the present invention will become apparent upon consideration of the following detailed descriptions of plural specific embodiments thereof, especially when taken in conjunction with the accompanying drawings.

Figure 1:
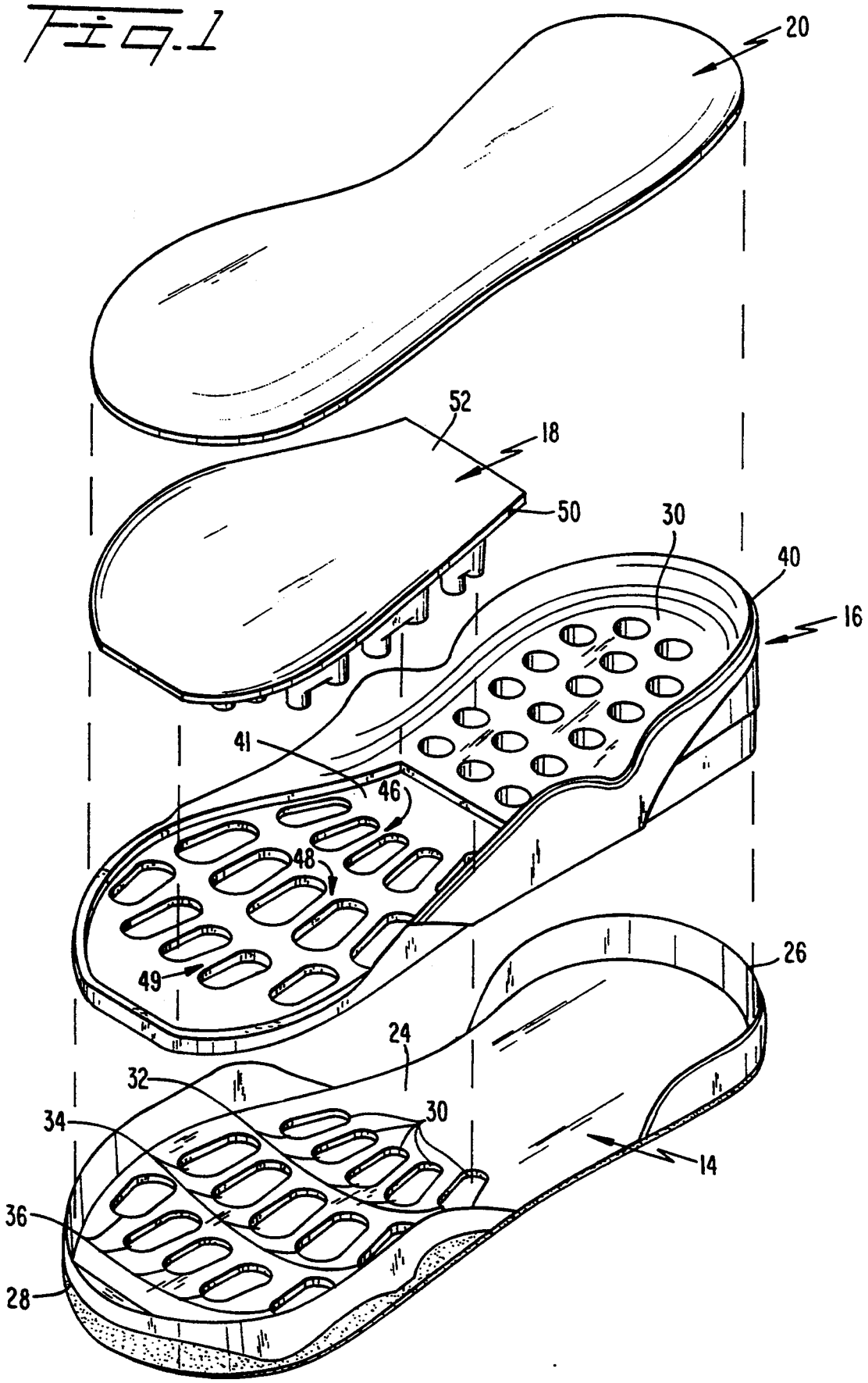
FIG. 1 is an exploded view of a shoe sole in accordance with a first preferred embodiment of the invention.
Figure 2:
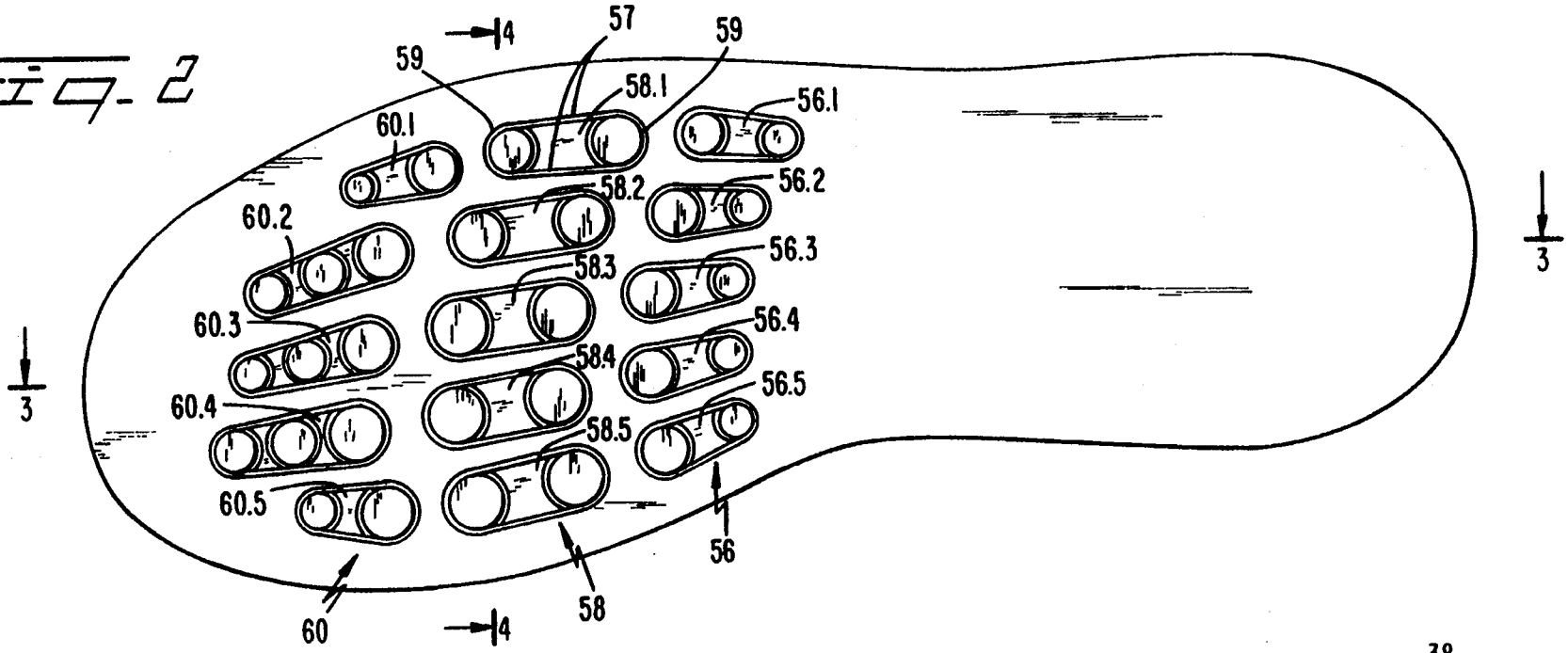
FIG. 2 is a bottom view of the outsole of the shoe sole illustrated in FIG. 1.
Figure 3:
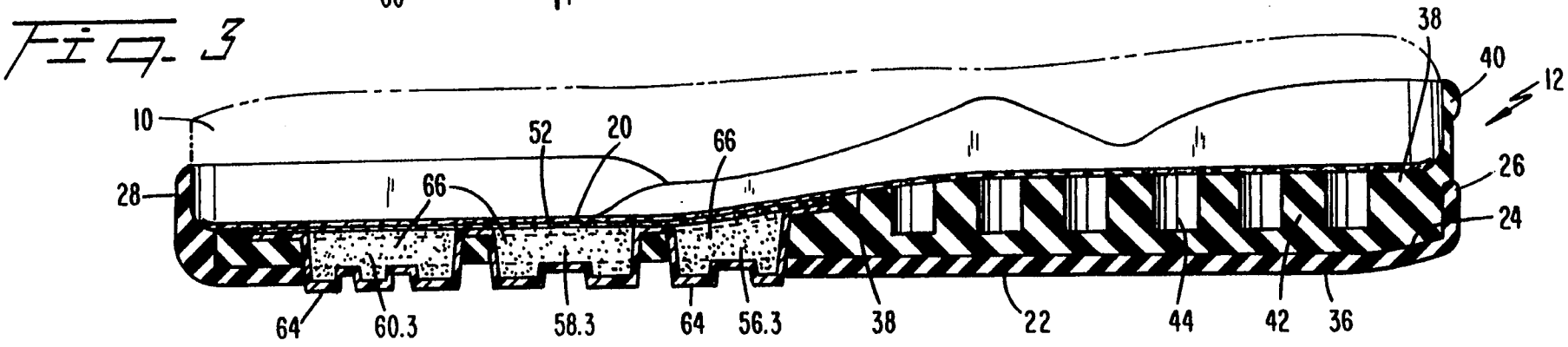
FIG. 3 is a side sectional view, taken through the line 3—3, FIG. 2, of a shoe including tee sole illustrated in FIG. 1.
Figure 5:
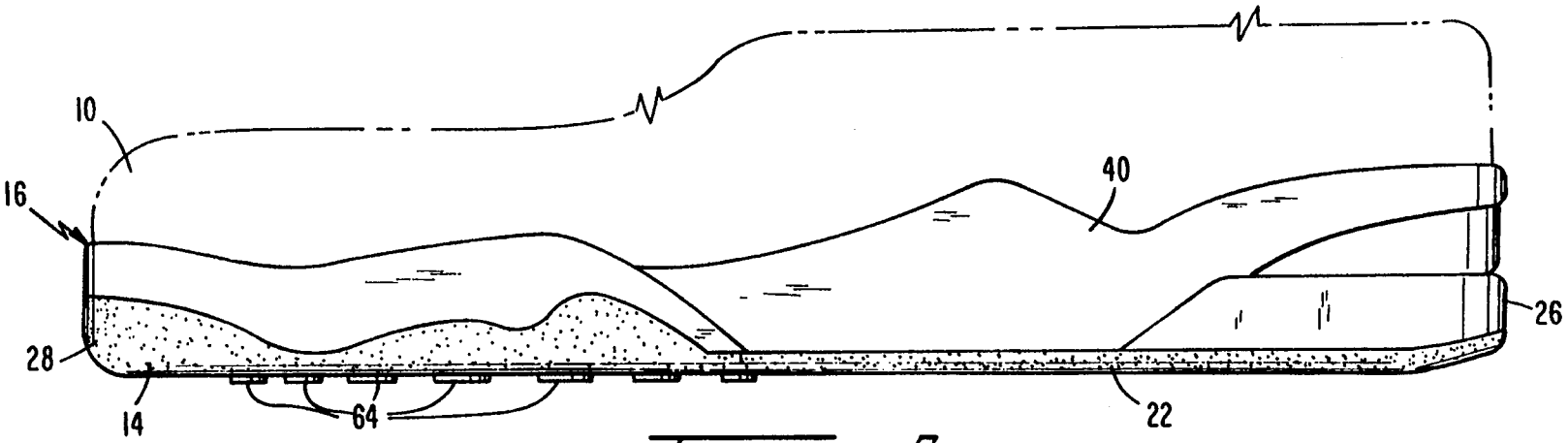
FIG. 5 is a side view of a shoe including the sole illustrated in FIG. 1.
Figure 4:
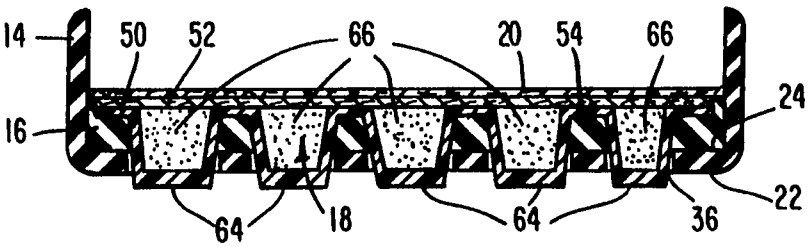
FIG. 4 is a side sectional view, taken through the line 4—4, FIG. 2, of the shoe sole illustrated in FIG. 1.
Figure 6:
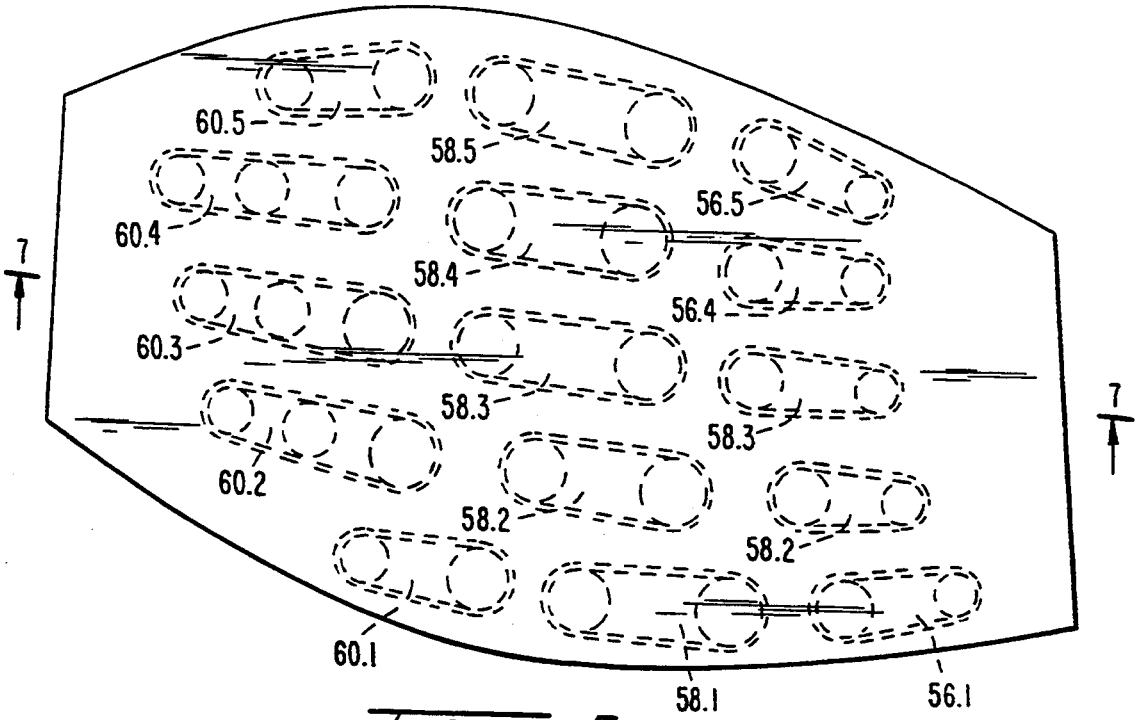
FIG. 6 is a top view of an insert included in the sole illustrated in FIG. 1.
Figure 7:
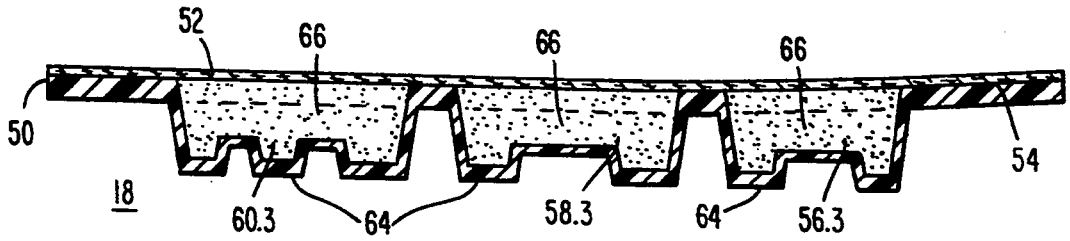
FIG. 7 is a side sectional view, taken througk the line 7—7, of the insert illustrated in FIG. 6.
Figure 8:
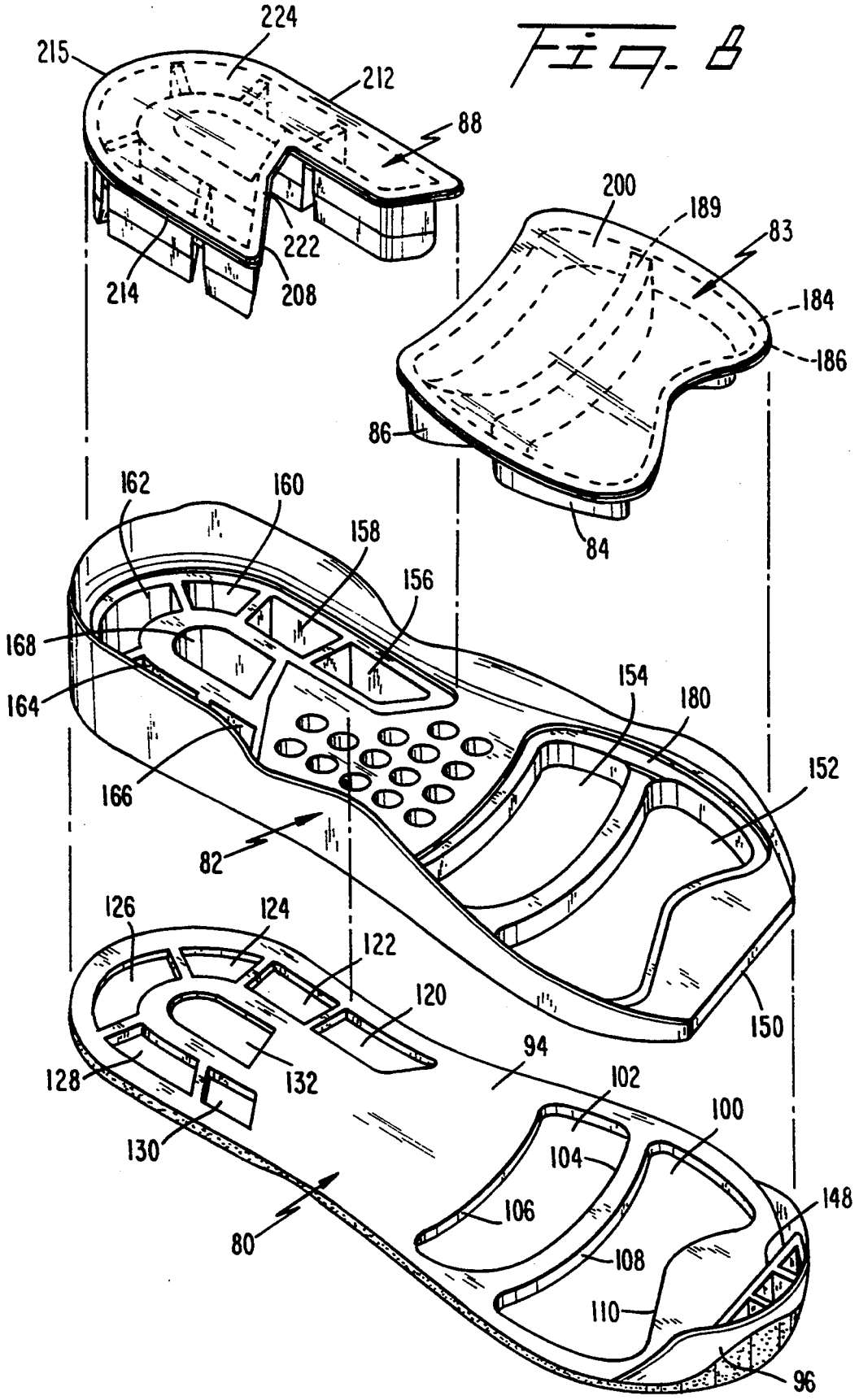
FIG. 8 is an exploded view of a second embodiment of a shoe sole in accordance with the present invention;.
Figure 9:
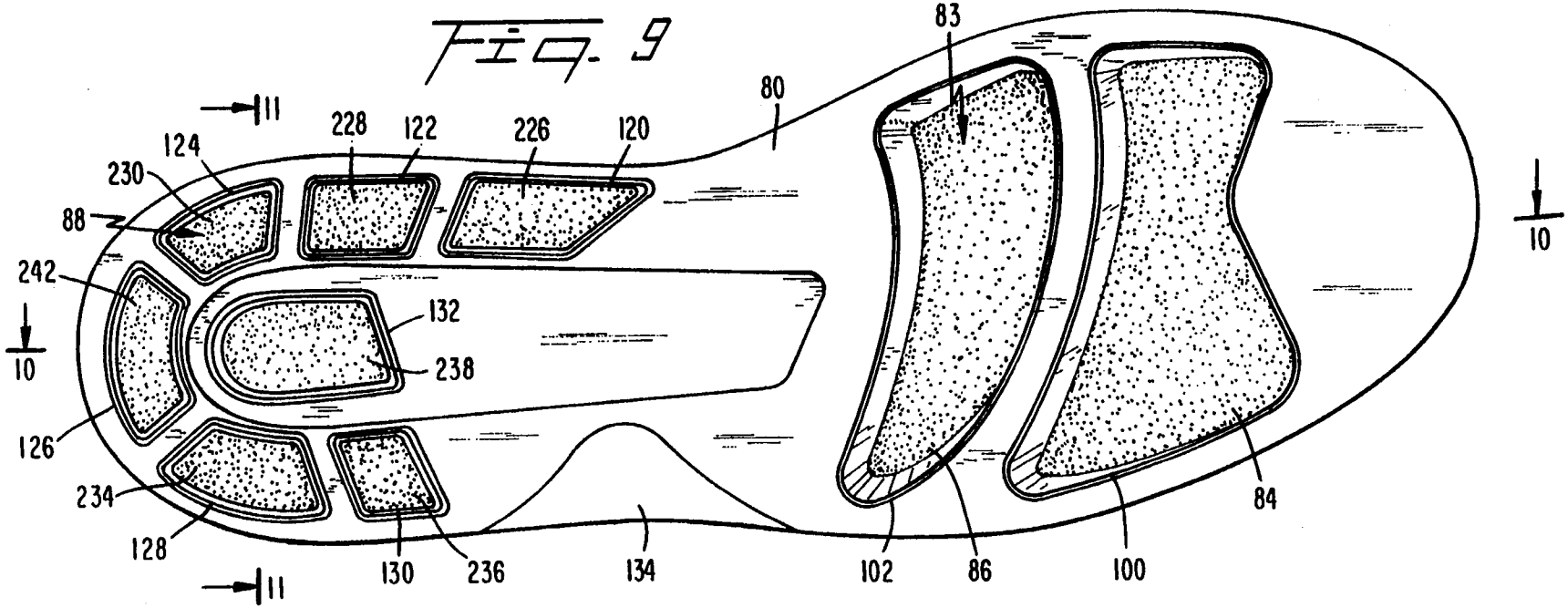
FIG. 9 is a bottom view of the outsole of the sole illustrated in FIG. 8.
Figure 10:
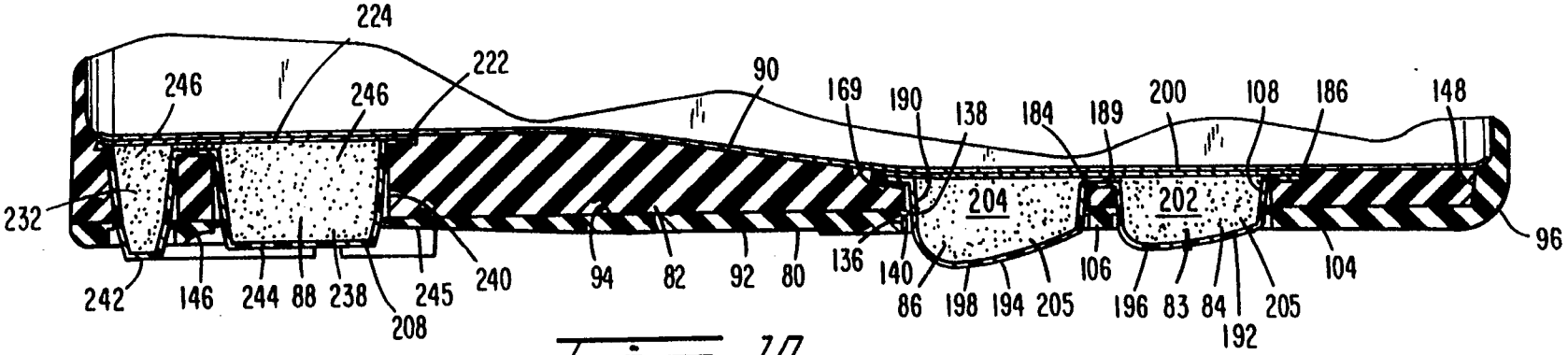
FIG. 10 is a side sectional view, taken through the line 10—10, FIG. 9, of a shoe including the sole illustrated in FIG. 8.
Figure 12:
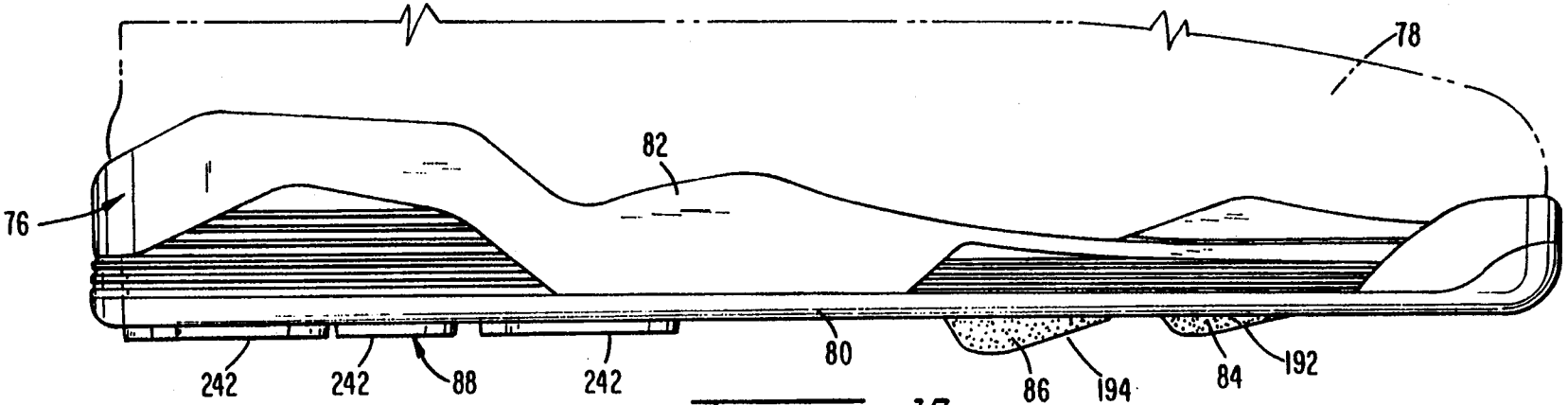
Figure 10A:
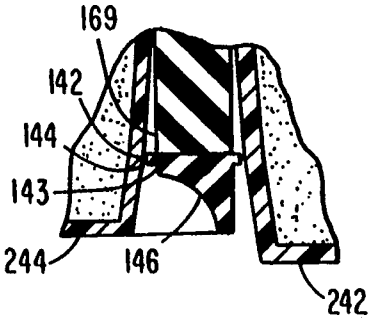
Figure 11:
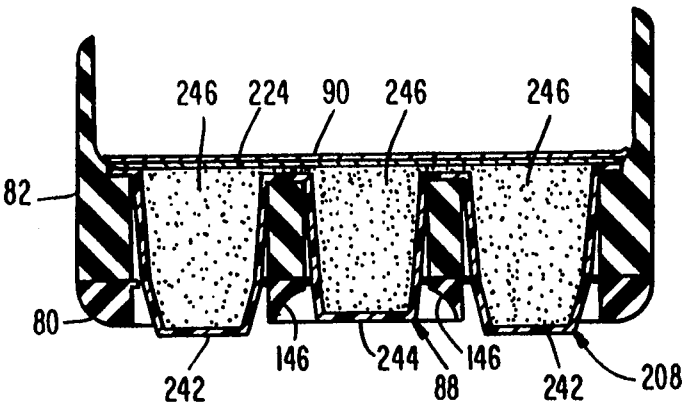
Figure 10B:
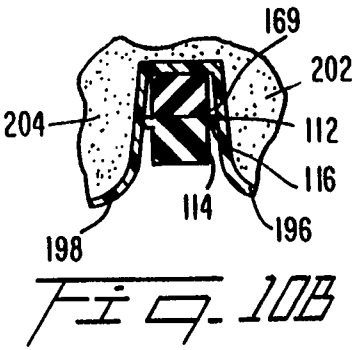
Figure 13:
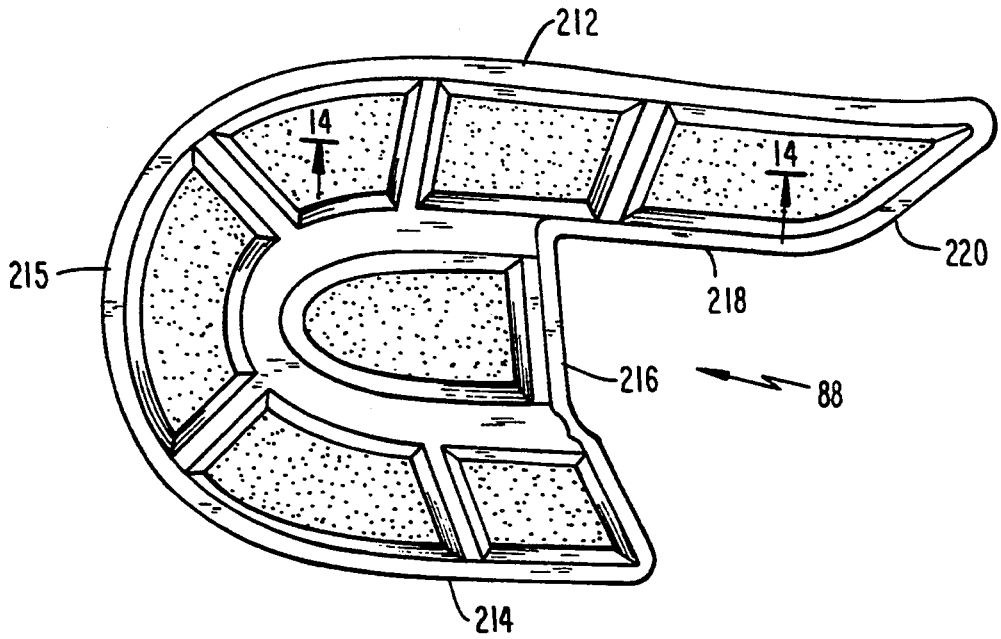
Figure 14:
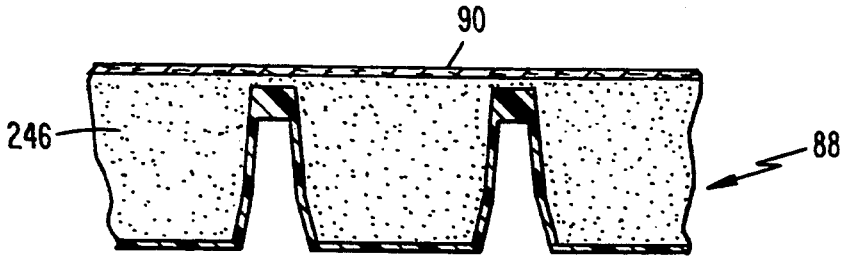

FIG. **10*a* is an enlarged side sectional view of a portion of the midsole between a pair of regions of a rear insert of the sole illustrated in FIG. 10**;

FIG. **10*b* is an enlarged side sectional view of a portion of the midsole between forward and rearward regions of a forward insert of the sole illustrated in FIG. 10**;

FIG. 11 is a transverse sectional view taken through the line 11—11, FIG. 9, in the heel region of the sole illustrated in FIG. 8;

FIG. 12 is a side view of a shoe including the sole illustrated in FIG. 8;

FIG. 13 is a top view of a rearward insert of the sole illustrated in FIG. 8; and FIG. 14 is a partial sectional view taken through the line 14—14, FIG. 13.

DESCRIPTION OF THE PREFERRED EMBODIMENTS

Reference is now made to FIGS. 1–7 of the drawing wherein a shoe incorporating one embodiment of the present invention is illustrated as including upper 10 (FIGS. 3 and 5) to which is bonded, by an appropriate cement, sole 12 including outsole 14, midsole 16, insert 18 and insole board 20.

Outsole 14 includes bottom face 22 which contacts a surface being traversed by a wearer of the shoes, upper face 24, rearward flange 26 and forward flange 28. Three elongated slot sets 30, 32 and 34 extend through outsole 14 between bottom and upper faces 22 and 24. Each of slot sets 30, 32 and 34 includes five slots, positioned such that the slots of rear and center slot sets 30 and 32 are approximately aligned with the five metatarsal bones of the foot, while the slots of forward slot set 34 are approximately aligned with the five proximal phalanges attached to the five metatarsal bones. In a preferred embodiment, outsole 14 is made of abrasion resistant rubber (for example, rubber having an abrasion resistance of 2,000 NBS) that is somewhat hard, having a durometer of approximately 60 Shore A scale.

Midsole 16 includes bottom face 36, top surface 38 and flange 40 which extends from the forward medial (inside) metatarsal portion of the foot around the heel to the lateral (outside) metatarsal portion of the foot. Midsole 16 is bonded to outsole 14 by appropriate application of cement between bottom face 36 of the midsole and top face 24 of the outsole. Upper surface 38 of midsole 16 includes cavity 41 in the forward portion thereof for receipt of insert 18 and rear portion 42 which slopes slightly upwardly and includes vertical cylindrical bores 44. The base of cavity 41 of midsole 16 includes three slot sets 46, 48 and 49, respectively corresponding in size and location with slots 30, 32 and 34 in outsole 14. Midsole 16 is made of a relatively hard, single density, plastic material, such as ethyl vinyl acetate (EVA) with the trademark PHYLON, having a durometer of approximately 60 Asker C scale.

Insert 18 includes shell 50, preferably fabricated of polyurethane having a durometer of approximately 60 Shore A scale. Fabric cover 52 is bonded to upper face 54 of shell 50. Shell 50 includes three sets of regions 56, 58 and 60, such that each region set includes five separate regions, corresponding in size and shape with slot sets 30, 32 and 34, respectively. Hence, region set 56 includes regions 56.1–56.5, region set 58 includes regions 58.1–58.5 and region set 60 includes regions 60.1–60.5. There are, therefore, five groups of regions, such that regions 56.1, 58.1 and 60.1 are in the first group along the lateral side of sole 12, regions 56.2, 58.2 and 60.2 are in a second group, etc. Each group of regions is associated with a metatarsal bone and the proximal phalange connected therewith. Each of regions 56.1–60.5 has, in the plan view, an elongated shape, defined by walls including straight, somewhat parallel side wall portions 57 and arcuate end wall portions 59; portions 57 and 59 are arranged so there is a smooth continuous transition between them. The walls of regions 56.1–60.5 depend downwardly from the portion of shell 50 bonded to cover 52.

Side and end wall portions 57 and 59 of each of regions 56.1–60.5 are tapered from the portion of shell 50 bonded to cover 52 toward tip 64 of the particular region; each of tips 64 has a substantially planar horizontal lower face that extends beyond bottom face 22 of outsole 14. While tips 64 are illustrated as including cylinders at opposite ends thereof, it is to be understood that the bottom of each tip can have the same shape as the remainder of the region, i.e., two longitudinally extending, somewhat parallel side wall portions and arcuate end wall portions.

In a preferred embodiment, the walls of regions 56.1–60.5 are tapered by between 12° and 15° from the vertical. The thickness of tips 64 is substantially greater than the thickness of the wall portions 57 and 59; in a preferred embodiment, the thickness of tips 64 is 2.5 mm, while the thickness of the wall portions 57 and 59 is about 1.25 mm. The planar, lower bases of tips 64 extend approximately 2.5 mm below bottom face 22 of outsole 14.

A chamber is formed in each of regions 56.1–60.5; the chamber of each region is defined by a volume bounded by the interior face of tip 64, the interior faces of wall portions 57 and 59, and the bottom face of fabric cover 52. Each of tile thus-formed chambers is filled with resilient, relatively soft, low density, sponge-like material, preferably open-cell polyurethane foam 66, having a durometer of approximately 30 Asker C scale.

Insert 18 is placed into cavity 41 so wall portions 57 and 59 of regions 56.1–60.5 fit snugly against the walls of the slots of slot sets 46, 48 and 49 of midsole 16, but are slightly spaced from the walls of the slots of slot sets 30, 32 and 34 of outsole 14. The bottom face of shell 50 directly beneath cover 52 is bonded by cement to the seat in cavity 41 of midsole 16. However, to provide independent movement of the different regions 56.1–60.5, it is important for there to be no adhesive or other type of bonding agent between wall portions 57 and 59 of the regions and the walls of the slots in midsole 16 or of the corresponding slot walls of outsole 14.

The geometry and materials of regions 56.1–60.5 and the interrelationship of the regions with outsole 14 and midsole 16 are such that tips 64 are compressed vertically to such an extent that the planar bottoms of the tips are substantially coplanar with bottom face 22 of outsole 14 when a particular tip strikes the surface being traversed, as during walking or playing tennis. In response to the bottom face of a particular tip 64 being vertically compressed, wall portions 57 and 59 of the region including the particular tip 64 expand horizontally, into contact with the walls of slot sets 46, 48 and 50 of midsole 16. The shock resulting from tip 64 striking the traversed surface is thereby transferred to the relatively large surface area of midsole 16 to be partially absorbed by the midsole and distributed to a large area of the sole of the wearer. There is accordingly a reduction in the amount of shock transmitted to the metatarsal bone or phalange associated with the particular region including the compressed tip.

It has been determined that the 12°–15° taper of wall portions 57 and 59 promotes optimal transfer of forces from tip 64 through foam 66, thence through the walls to midsole 16. Relatively thin wall portions 57 and 59 bow out in response to the applied force. The outward bowing is enhanced by the smooth, continuous transition between side and end wall portions 57 and 59. Tip 64 is relatively thick to prevent it from bowing substantially and to enhance wear characteristics of the tips.

Because wall portions 57 and 59 are not fixedly attached to outsole 14 or midsole 16, the regions of sets 56, 58 and 60 are free to move up and down and swing relative to each other and the remainder of sole 12. Independent movement of regions 56.1–60.5 provides enhanced stability and traction. Different portions of bottom face 22 of outsole 14 and different ones of tips 64 touch the surface being traversed at different times as the shoe, including sole 12, is being used for various purposes, such as walking, running or playing tennis. In walking, for example, the regions of set 56 usually strike the surface being traversed before the regions of sets 58 and 60, while in running, the regions of set 60 usually strike the surface before the regions of sets 56 and 58.

Assume, for example, that tip 64 of lateral region 56.1 strikes the surface being traversed before any of the other tips. In response to such a striking, region 56.1 compresses vertically so the bottom of tip 64 of region 56.1 is aligned with bottom face 22 of outsole 14. Next, assume that at the time the bottom of tip 64 of region 56.1 is aligned with the bottom face of outsole 14, contact with the surface being traversed is just being initiated by tip 64 of region 60.5, at the medial (inside) of the foot; hence there is virtually no deflection of region 60.5. The tips of the regions of sets 56, 58 and 60 between regions 56.1 and 60.5 are, at the stated time, in various states of compression and deflection in the vertical direction.

Stability is enhanced under these circumstances because there is more contact area between the traversed surface and tip 64 of region 56.1 and the area immediately surrounding it (where the striking force of the shoe against the traversed surface is greatest) than any other part of outsole 14 and the remaining tips of insert 18. Traction is enhanced because of the protrusions of tips 64 that are not aligned with the bottom surface. Because of the materials and geometry of regions 56.1–60.5, different portions of the bottom face of a single tip 64 contact the traversed surface at different times to provide a rocking motion that enhances the normal forward and rearward and side-to-side motions of the foot during walking, running and playing tennis. The tips swing up to ±9° relative to an axis normal to bottom face 22 of outsole 14. This swinging motion is imparted to tips 64 and is in addition to the up and down movement of the tips.

Due to the independent motion of regions 56.1–60.5 relative to each other and the remainder of sole 12, a relatively large surface area is always in contact with the surface being traversed to provide greater traction and stability than conventional sole arrangements. This provides compliance of the bottom faces of tips 64 and outsole 14 with the motion of the foot as the bottom of the shoe strikes the traversed surface.

Reference is now made to FIGS. 8–14 of the drawings wherein a second embodiment of the invention is illustrated as including sole 76, attached to upper 78. Sole 76 includes outsole 80, midsole 82, as well as forward insert 83 and rearward insert 88. Insert 83 includes regions 84 and 86 that extend through midsole 82 and outsole 80 in forward and rearward metatarsal regions, respectively, while insert 88 includes regions that extend through the midsole and outsole in the rearward portion of the shoe, beneath the tarsal and calcaneus bones. Liner board 90 extends across and is bonded by cement to the tops of midsole 82 and inserts 83 and 88.

Outsole 80, preferably made of the same material as outsole 14, includes generally planar bottom and top faces 92 and 94 and toe flange 96. Elongated openings 100 and 102 in outsole 80 extend transversely of the outsole, beneath forward and rearward regions of the metatarsal bones. Openings 100 and 102 are spaced from each other along the longitudinal axis of outsole 80.

Opening 102 includes front and rear transversely extending arcuate, somewhat parallel walls 104 and 106, bowed outwardly toward the toe of the outsole. Rear wall 108 of opening 100 (shaped somewhat like a kidney) is curved and is generally parallel to front wall 104 of opening 102, while front wall 110 of opening 100 includes two somewhat straight segments that meet at a smooth apex set back from the toe of outsole 80.

In vertical cross-section, openings 100 and 102 have a greater surface area on bottom face 92 than on top face 94, a result achieved by providing the openings with displaced upper and lower vertical wall segments 112 and 114, connected to each other by flange 116. Openings 100 and 102 are positioned, shaped and arranged to receive regions 84 and 86, which project through the openings, beyond bottom face 92 of outsole 80.

In the rear of outsole 80 are openings 120, 122, 124, 126, 128, 130 and 132, positioned and arranged to receive corresponding projecting regions of insert 88 that extend through outsole 80, beyond bottom face 92 thereof. Openings 120, 122 and 124 are longitudinally spaced from each other toward the lateral side of outsole 80, below the location of the tarsal and calcaneus bone of the wearer. Opening 120 is generally opposite from the rear portion of arch indentation 134 while opening 124 is proximate the very rear portion of outsole 80, with opening 122 being between openings 120 and 124. Openings 128 and 130 are longitudinally spaced from each other somewhat close to the medial side of outsole 80, such that opening 130 is slightly to the rear of arch indentation 134 while opening 128 extends from a region slightly to the rear of opening 130 close to the very rear of outsole 80. Opening 126 extends generally transversely of outsole 80, between openings 124 and 128, while opening 132 extends longitudinally in the center of outsole 80, between openings 124, 128 and 130, to the forward end of opening 122.

Opening 126 has a relatively large area and the combined areas of openings 120, 122 and 124 is considerably larger than the combined area of openings 128 and 130. Each of openings 120, 122, 124, 1126, 128 and 130 has a side wall including a pair of vertical portions connected together by a shelf, as indicated by reference numerals 136', 138' and 140' for opening 126 and similar to the side walls 136 and 138 and shelf 140 of openings 100 and 102. In contrast, opening 132 has a side wall including vertical segments 142, 143, horizontal segment 144 and flared segment 146 that extends outwardly, in a downward manner, to bottom face 92.

Outsole 80 also includes wall 148, located slightly to the rear of the forwardmost portion of the toe of the outsole. Wall 148 extends transversely of outsole 80 to assist in maintaining midsole 82 in place, so the midsole does not have a tendency to slide forward.

Midsole 82, in plan view, has an exterior shape and size corresponding with the interior shape and size of outsole 80 so the midsole fits snugly into the outsole with the bottom face of the insole contacting the top (interior) face of the outsole. The bottom face of midsole 82 is bonded, by cement, to the top, interior face of outsole 80. Midsole 82 includes straight transverse side 150 that abuts against wall 148 in outsole 80. Midsole 82 is made of the same material as midsole 16 of sole 12; the two midsoles perform similar functions.

Midsole 82 includes transverse openings 152 and 154, which are aligned with and have approximately the same size and shape as transverse openings 100 and 102 of outsole 80. Midsole 82 also includes openings 156, 158, 160, 162, 164, 166 and 168 which respectively have approximately the same size, shape, and relative location as corresponding openings 120, 122, 124, 126, 128, 130 and 132, with which the midsole openings are respectively aligned. All of openings 152–168 of midsole 82 have straight vertical walls 169. Openings 152 and 154 are surrounded by cavity 180, in the upper face of midsole 82, while openings 156, 158, 160, 162, 164, 166 and 168 are surrounded by cavity 182, also on the upper face of the midsole. Cavities 180 and 182 have approximately the same exterior shapes and sizes as the exterior shapes and sizes of inserts 83 and 88, respectively. Inserts 83 and 88 are dropped into cavities 180 and 182, respectively, so bottom, flat faces of the inserts (from which protruding regions extend) rest on planar faces of the cavities; the contacting flat faces of the inserts and cavities are bonded together by cement.

Insert 83 includes polyurethane shell 184, preferably constructed of the same material as shell 50. Shell 184 includes upper plate 186 from which downwardly depend walls 188 and 190 that define the exterior walls of regions 84 and 86. Shell 184 includes bridge 189 for centrally connecting regions 84 and 86 to each other. Bottom tips 192 and 194 of regions 84 and 86 extend generally horizontally with a slight downward inclination, from the front of walls 188 and 190 toward the rear of the walls. Ridges 196 and 198, at the zeniths of tips 192 and 194 from plate 186, are in much closer proximity to the rear portions of walls 188 and 190 than to the front portions of the respective walls. Ridge 198 is somewhat farther from plate 186 than ridge 196; in a preferred embodiment, ridge 188 is 3 mm farther from plate 186 than ridge 196.

The upper face of plate 186 is attached to planar cover 200, preferably fabricated of a fibrous material. Tips 192 and 194 are preferably considerably thicker than walls 188 and 190; in the preferred embodiment, tips 192 and 194 are 2.5 mm thick, while walls 188 and 190 are 1.25 mm thick, so the walls and tips of regions 84 and 86 function similarly to the walls and tips of the protruding regions of insert 18. Chambers 202 and 204 are thereby formed between the interior surfaces of the walls and tips of regions 84 and 86 and cover 200. Chambers 202 and 204 are filled with foam 205, preferably the same foam as is used to fill the chambers of regions 56.1–60.5 of insert 18.

Insert 83 is placed in cavity 180 so regions 84 and 86 extend through openings 152 and 154 of midsole 82 and through openings 100 and 102 of outsole 80. Walls 188 and 190 of regions 84 and 86 fit snugly against corresponding walls of openings 152 and 154 of midsole 82 and against wall portions 112 of openings 100 and 102, but are somewhat displaced from wall portions 114 of openings 100 and 102. The walls of regions 84 and 86 are not fixedly attached or bonded in any way to the walls of openings 152 and 154 of midsole 82 or openings 100 and 102 of outsole 80 so the regions can move independently of each other and the remainder of sole 76. Tips 192 and 194 protrude beyond bottom face 92 of outsole 80 in such a manner that, in the preferred embodiment, ridge 198 is displaced from bottom face 92 of outsole 80 by 7 mm, while ridge 196 is displaced from face 92 by 4 mm. Regions 84 and 86 are arranged so side walls 188 and 190 thereof do not protrude appreciably beyond bottom face 92 of outsole 80 and tips 192 and 194 and are to a large extent the only portions of the regions which extend beyond the bottom outsole face.

Rearward insert 88 includes shell 208, preferably fabricated of the same material as the shells of inserts 18 and 83. In plan view, shell 208 includes somewhat straight lateral and medial side walls 212 and 214, connected together by arcuate rear wall 215 in the heel region of shoe 78. Lateral side wall 212 is significantly longer than medial side wall 214 such that the lateral side wall extends approximately to the arch of the shoe, while the medial side wall ends just before the beginning of the rear portion of arch indentation 134. Transverse wall 216 extends from the end of medial side wall 214 adjacent the arch. Transverse wall 216 extends beyond the center line of insert 88 and sole 76. Wall 216 extends to longitudinally extending wall 218, that ends somewhat short of the end of lateral wall 212 opposite from arch indentation 134. Longitudinal wall 218 and the end of lateral side wall 212 are connected together by wall 220 so walls 218 and 220 and the portion of lateral wall 212 extending beyond wall 216 form a tongue-like appendage.

In cross-section, shell 208 includes upper plate 222, having an upper face that is bonded to the lower face of fabric cover plate 224. Regions 226, 228, 230, 232, 234, 236 and 238 extend downwardly from plate 222. In plan view, regions 226–238 are shaped, sized and positioned relative to each other in substantially. the same manner as openings 120–132 in outsole 80 and openings 156–168 in midsole 82. Regions or pods 226–238 extend through openings 156–168 and 120–132 so the bottom tips of the regions extend beyond bottom face 92 of outsole 80. Each of regions 226–236 has virtually the same length, while region 238 is somewhat shorter so bottom tips 242 of regions 226–236 extend beyond the bottom face 92 of outsole 80 by a distance that is slightly greater than bottom tip 244 of region 238.

Shell 222 includes side walls 240 and bottom tips 242 and 244, having planar bottom faces. Side walls 240 and tips 242 and 244 define the exterior of regions 226–238. Side walls 240 are tapered from plate 220 toward tips 242 and 244 so the side walls of regions 226–238 are slightly spaced from side walls 169 of openings 156–160 except at the intersections of side walls 169 with plate 222. Side walls 240 are virtually in contact with side wall segments 138 of outsole 80 and are somewhat removed from side wall portions 136. This geometry permits independent up and down, as well as limited rocking, motions of regions 226–238. The region side walls are not fixedly attached to the sidewalls of any of the openings in outsole 80 or midsole 82. The lower face of plate 222 is bonded to the upper face of cavity 182.

In the preferred embodiment, walls 240 are approximately 1.25 mm thick, while tips 242 and 244 are approximately 2.5 mm thick. Tips 244 of each of regions 226–236 extend about 2 mm beyond the bottom portions of bottom face 92 immediately adjacent to them. The bottom portion of face 92 includes upwardly cambered segment 245 that extends toward the forward portion of wall 240 of region 238 so tip 242 of region 238 extends 2 mm below the cambered segment immediately adjacent thereto. However, the bottom of tip 242 is horizontally aligned with the bottom face of outsole 80, except where cambered segment 245 is located and where the openings in bottom face 92 of outsole 80 are located. The rear and side portions of tip 242 also extend approximately 2 mm from the bottom face of outsole 80 immediately adjacent thereto as a result of flared side wall 146, to the rear and sides of opening 132.

The stated construction for center heel region 238 helps to provide traction for the center portion of the heel of the wearer, without applying significant pressure to this region of the foot. The protrusion of tips 244 of exterior regions 226–236 beyond bottom face 92 of outsole 80 provides traction and stability for the same reasons discussed supra for regions 56.1–60.5.

Regions 226–238 are arranged so the tips 242 and 244 thereof have differing surface areas, resulting in each of the regions having a differing volume. Because of the different surface areas of regions 226–238, a different pressure is required to compress each individual region as the region tip strikes the surface being traversed. Because the tips of regions 232 and 234 are relatively large, these regions compress relatively easily to absorb shock resulting from the tips of these regions striking a surface being traversed. Chambers 228 and 230 on the lateral side of insert 88 have a smaller surface area and, therefore, do not compress as easily as regions 232 and 234. During walking by the vast majority of wearers, the lateral heel portion of sole 76, where regions 228 and 230 are located, initially strikes the surface being traversed. Because regions 228 and 230 are relatively hard, they do not compress as much as regions 232 and 234. This helps force the foot of the wearer to flatten out and move the weight of the foot of the wearer toward the medial side of insert 88. Hence, the arrangement of the protruding regions of heel insert 88 helps to correct pronation of the wearer.

Regions 226–238 help to distribute the shock which occurs when the insert strikes the surface being traversed, in a similar manner to the way regions 56.1–60.5 help to distribute the shock. In particular, tips 242 and 244 of regions 226–238 compress vertically, so they are aligned with the bottom portions of bottom face 92 of outsole 80 immediately surrounding each tip. As tips 242 and 244 compress vertically, walls 240 expand outwardly, against walls 169 of openings 156–168 of midsole 82. Thereby, the shock imparted to tips 242 and 244 of regions 226–238 is distributed over the relatively large surface area of midsole 82, via tips 242 and 244, the open-cell polyurethane foam 246 in the chambers of the regions, and the walls of the regions.

Regions 84 and 86 are also constructed to assist in a natural heel-to-toe motion during walking. During walking, the rear portion of the forefoot strikes the traversed surface prior to the front portion of the forefoot. Hence, ridge 198 of rearward region 86 strikes the surface being traversed before ridge 196 of forward region 84. As the weight of the wearer shifts from rearward region 86 to forward region 84, the forward region compresses. In many situations, ridges 196 and 198 compress so they are vertically aligned with the portions of bottom face 92 of outsole 80 that surrounds the ridges. When ridge 196 is fully compressed, into closest proximity with bottom face 92, ridge 198 begins to expand away from bottom face 92 to impart a rocking motion to the foot of the wearer and thereby assist the natural heel-to-toe motion of walking.

While there have been described and illustrated plural specific embodiments of the invention, it will be clear that variations in the details of the plural embodiments specifically illustrated and described may be made without departing from the true spirit and scope of the invention as defined in the appended claims.

We claim:

1. A shoe comprising an upper and a sole attached to the upper, the sole including an outsole, an insole, a midsole between the insole and outsole and an insert, the midsole having (a) a bottom surface mating with and attached to an upper surface of the outsole, and (b) a cavity where the insert is located, the insert including at least one region extending through openings in the midsole and outsole without being attached to the midsole or outsole, the region including a bottom tip extending beyond a bottom face of the outsole, the region including the bottom tip and the openings being arranged and dimensioned so the region compresses vertically and expands horizontally against the midsole in response to the tip striking a surface to be traversed so the midsole absorbs forces applied to the tip.

2. The shoe of claim 1 wherein the region including the bottom tip has a chamber extending between a foot-bearing region of the shoe and the tip, the chamber being filled with a foam that is softer than the remainder of the sole, the bottom tip being sufficiently soft to compress vertically when the bottom face strikes the surface to be traversed to transmit some of the striking force to the foam which in turn expands horizontally against a side wall of the region including the bottom tip which expands horizontally against the midsole.

3. The shoe of claim 2 wherein the region including the bottom tip has an exterior side wall that is tapered toward the tip thereof to assist in transmitting some of the striking force horizontally against the midsole.

4. The shoe of claim 2 wherein five longitudinally extending groups of the regions including the bottom tips are provided, each group being approximately aligned with one of the five metatarsal bones.

5. The shoe of claim 4 wherein each region including the bottom tip has an exterior side wall that is tapered toward the tip thereof, the side wall taper being displaced approximately 12°–15° relative to an axis of the region including the bottom tip normal to the bottom face.

6. The shoe of claim 5 wherein the tip has a thickness substantially greater than the side wall thickness.

7. The shoe of claim 6 wherein the side wall and tip thicknesses are approximately 1.25 mm and 2.50 mm, respectively.

8. The shoe of claim 2 wherein the tip and foam respectively have durometers of about 60 Shore A and 30 Asker C scale.

9. The shoe of claim 2 wherein a pair of the regions including the bottom tips are provided and extend transversely of the outsole so they are beneath at least three metatarsal bones, one of the regions including the bottom tips being a front region and the other being a rear region.

10. The shoe of claim 9 wherein the tips of said regions including the bottom tips are ridges extending approximately transversely to the outsole.

11. The shoe of claim 10 wherein the ridge of the rear region is farther from the bottom of the outsole than the ridge of the front region.

12. The shoe of claim 11 wherein the front and rear regions are connected together in the midsole.

13. The shoe of claim 2 wherein a plurality of the regions are provided in the rear portion of the sole, the tips of some of the regions having differing surface areas.

14. The shoe of claim 13 wherein some of the rear portion regions having the bottom tips extend about the periphery of the rear of the shoe, a region having the bottom tip at the very rear of the sole having a tip surface area substantially greater than that of a rear portion region on the sole lateral side so the very rear region compresses to a greater extent than the lateral side region in response to the same force being applied to them.

15. The shoe of claim 1 wherein a plurality of the regions are provided in the rear portion of the sole, the tips of some of the regions having differing surface areas.

16. The shoe of claim 15 wherein some of the rear portion regions having the bottom tips extend about the periphery of the rear of the shoe, a region having the bottom tips at the very rear of the sole having a tip surface area substantially greater than that of a rear portion region on the sole lateral side so the very rear region compresses to a greater extent than the lateral side region in response to the same force being applied to them.

17. The shoe of claim 2 wherein said insert includes at least several of said regions extending through the midsole and outsole without being attached to the midsole or outsole so said regions move independently of each other in response to the bottom tips thereof striking a surface to be traversed including a bottom tip extending beyond a bottom face of the outsole.

18. The shoe of claim 1 wherein said insert includes at least several of said regions extending through the midsole and outsole without being attached to the midsole or outsole so said regions move independently of each other in response to the bottom tips thereof striking a surface to be traversed including a bottom tip extending beyond a bottom face of the outsole.

19. The shoe of claim 18 wherein the regions including the bottom tip have an exterior side wall, the exterior side wall being tapered toward the bottom tip of the region to assist in transmitting some of the striking force horizontally against the midsole.

20. The shoe of claim 18 wherein five longitudinally extending groups of the regions including the bottom tips are provided, each group being approximately aligned with one of the five metatarsal bones.

21. The shoe of claim 1 wherein a paiur of the regions including the bottom tips are provided and extend transversely of the outsole so they are beneath at least three metatarsal bones, one of the regions including the bottom tips being a front region and the other being a rear region.

22. The shoe of claim 21 wherein the tips of said pair of the regions are shaded as ridges extending approximately transversely to the outsole.

23. The shoe of claim 22 wherein the ridge of the rear region is farther from the bottom of the outsole than the ridge of the front region.

24. The shoe of claim 23 wherein the front and rear regions are connected together in the midsole.

25. The shoe of claim 17 wherein a plurality of the regions are provided in the rear portion of the sole, the tips of some of the regions having differing surface areas.

26. The shoe of claim 25 wherein some of the rear portion regions having the bottom tips extend about the periphery of the rear of the shoe, a region having the bottom tips at the very rear of the sole having a tip surface area substantially greater than that of a rear portion region on the sole lateral side so the very rear region compresses to a greater extent than the lateral side region in response to the same force being applied to them.

* * * * *